US005781828A

United States Patent [19]

Caruthers, Jr. et al.

[11] Patent Number: 5,781,828

[45] Date of Patent: Jul. 14, 1998

[54] LIQUID COLOR MIXING AND REPLENISHMENT SYSTEM FOR AN ELECTROSTATOGRAPHIC PRINTING MACHINE

[75] Inventors: Edward B. Caruthers, Jr., Rochester; James R. Larson, Fairport; Fong-Jen Wang, Pittsford; George A. Gibson, Fairport; R. Enrique Viturro, Rochester, all of N.Y.

[73] Assignee: Xerox Corporation, Stamford, Conn.

[21] Appl. No.: 721,422

[22] Filed: Sep. 26, 1996

[51] Int. Cl.[6] ..... G03G 15/10

[52] U.S. Cl. ..... 399/57; 399/233; 399/58

[58] Field of Search ..... 399/54, 57, 223, 399/233, 238, 224, 58, 60; 430/117–119

[56] References Cited

U.S. PATENT DOCUMENTS

| | | | |
|---|---|---|---|
| 5,204,208 | 4/1993 | Paine et al. | 430/137 |
| 5,231,454 | 7/1993 | Landa | 399/53 |
| 5,240,806 | 8/1993 | Tang et al. | 430/115 |
| 5,369,476 | 11/1994 | Bowers . | |
| 5,370,962 | 12/1994 | Anderson et al. | 430/137 |
| 5,557,393 | 9/1996 | Goodman et al. | 399/223 |

OTHER PUBLICATIONS

XDJ–vol. 21, No. 2 Mar./Apr. 1996 pp. 155–157 Title: "Custom Color Liquid Ink Development" Author: Nancy B. Goodman.

*Primary Examiner*—Robert Beatty
*Attorney, Agent, or Firm*—Denis A. Robitaille

[57] ABSTRACT

A system and method for color mixing management in an electrostatographic printing system, wherein a developing material reservoir containing an operative solution of colored developing material including a mixture of selected color components is continuously replenished with selected differently colored developing material concentrates in a predetermined ratio so as to be capable of producing a customer selectable color image area on an output substrate. The present invention may also be utilized to mix a customer selectable color in situ, either from stored proportions known to compensate for developability differences or from approximate amounts of primary color components initially deposited and mixed in the developing material reservoir with the resultant operative developing material mixture continually developed and replenished with a predetermined ratio of color components until the developing material mixture reaches a steady state color.

49 Claims, 1 Drawing Sheet

LIQUID COLOR MIXING AND REPLENISHMENT SYSTEM FOR AN ELECTROSTATOGRAPHIC PRINTING MACHINE

FIELD OF THE INVENTION

This invention relates generally to a development system for creating color output images in an electrostatographic printing machine and, more particularly, concerns a system for providing and maintaining customer selectable color output in an electrostatographic printing system. The color mixing and replenishment system operates by providing an operational mixture of developing material made up of two or more individual color developing materials while controlling the replenishment of the operational mixture by continuously adding predetermined concentrations of basic color components corresponding to the desired color of the output image.

BACKGROUND OF THE INVENTION

Generally, the process of electrostatographic copying and printing is initiated by exposing a light image of an original input document or signal onto a substantially uniformly charged photoreceptive member. Exposing the charged photoreceptive member to a light image discharges selective areas of the photoreceptive member, creating an electrostatic latent image on the photoreceptive member corresponding to the original input document or signal. This latent image is subsequently developed into a visible image by a process in which developing material is deposited onto the surface of the photoreceptive member. Typically, the developing material comprises carrier granules having toner particles adhering triboelectrically thereto, wherein the toner particles are electrostatically attracted from the carrier granules to the latent image to create a powder toner image on the photoreceptive member. Alternatively, liquid developing materials comprising pigmented marking particles (or so-called toner solids) and charge directors dispersed in a carrier liquid have been utilized, wherein the liquid developing material is applied to the latent image with the marking particles being attracted toward the image areas to form a developed liquid image. Regardless of the type of developing material employed, the toner or marking particles of the developing material are electrostatically attracted to the latent image to form a developed image and the developed image is subsequently transferred from the photoreceptive member to a copy substrate, either directly or via an intermediate transfer member. Once on the copy substrate, the image may be permanently affixed to provide a "hard copy" output document. In a final step, the photoreceptive member is cleaned to remove any charge and/or residual developing material from the photoconductive surface in preparation for subsequent imaging cycles.

The above-described electrostatographic reproduction process is well known and is useful for so-called light lens copying from an original document, as well as for printing of electronically generated or stored images where the electrostatic latent image is formed via a modulated laser beam. Analogous processes also exist in other printing applications such as, for example, ionographic printing and reproduction where charge is deposited in image configuration on a charge retentive surface (see, for example, U.S. Pat. Nos. 4,267,556 and 4,885,220, among numerous other patents and publications). Some of these printing processes, such as light lens generated image systems operate in a manner wherein the charged areas are developed (so-called CAD, or "write white" systems), while other printing processes operate in a manner such that discharged areas are developed (so-called DAD, or "write black" systems). It will be understood that the instant invention applies to all various types of electrostatographic printing systems and is not intended to be limited by the manner in which the image is formed or developed.

It is well known that conventional electrostatographic reproduction processes can be adapted to produce multicolor images. For example, the charged photoconductive member may be sequentially exposed to a series of color separated images corresponding to the primary colors in an input image in order to form a plurality of color separated latent images. Each color separated image is developed with a complimentary developing material containing a primary color or a colorant which is the subtractive compliment of the color separated image, with each developed color separated image subsequently superimposed, in registration, on one another to produce a multicolor image output. Thus, a multicolor image is generated from patterns of different primary colors or their subtractive compliments which are blended by the eye to create a visual perception of a color image.

This procedure of separating and superimposing color images produces so-called "process color" images, wherein each color separated image comprises an arrangement of picture elements, or pixels, corresponding to a spot to be developed with toner particles of a particular color. The multicolor image is a mosaic of different color pixels, wherein the color separations are laid down in the form of halftone dots. In halftone image processing, the dot densities of each of the color components making up the multicolor image can be altered to produce a large variation of color hues and shades. For example, lighter tints can be produced by reducing the dot densities such that a greater amount of white from the page surface remains uncovered to reflect light to the eye. Likewise, darker shades can be produced by increasing the dot densities. This method of generating process color images by overlapping halftones of different colors corresponding to the primary colors or their subtractive equivalents is well known in the art and will not be further described herein.

With the capabilities of electrostatographic technology moving into multicolor imaging, advances have also been directed to the creation of so-called "highlight color" images, wherein independent, differently colored, monochrome images are created on a single output copy sheet, preferably in a single processing cycle. Likewise, "spot color" and/or "high-fidelity" color printing has been developed, wherein a printing system capable of producing process color output images is augmented with an additional developer housing containing an additional color beyond the primary or subtractive colors used to produce the process color output. This additional developer housing is used for developing an independent image with a specific color (spot color) or for extending the color gamut of the process color output (high fidelity color). As such, several concepts derived from conventional electrostatographic imaging techniques which were previously directed to monochrome and/or process color image formation have been modified to generate output images having selected areas that are different in color than the rest of the document. Applications of highlight color include, for example, emphasis on important information, accentuation of titles, and more generally, differentiation of specific areas of text or other image information.

One exemplary highlight color process is described in U.S. Pat. No. 4,078,929 to Gundlach, wherein independent images are created using a raster output scanner to form a tri-level image including a pair of image areas having different potential values and a non-image background area generally having a potential value intermediate the two image areas. As disclosed therein, the charge pattern is developed with toner particles of first and second colors, where the toner particles of one of the colors are positively charged and the toner particles of the other color are negatively charged, therefore producing a highlight color image.

One specific application of highlight color processing is customer selectable color printing, wherein a very specific highlight color is required. Customer selectable colors are typically utilized to provide instant identification and authenticity to a document. As such, the customer is usually highly concerned that the color meets particular color specifications. For example, the red color associated with Xerox' digital stylized "X" is a customer selectable color having a particular shade, hue and color value. Likewise, the particular shade of orange associated with Syracuse University is a good example of a customer selectable color. A more specialized example of a customer selectable color output can be found in the field of "custom color", which specifically refers to registered proprietary colors, as used, for example, in corporate logos, authorized letterhead and official seals. The yellow associated with Kodak brand products, and the brown associated with Hershey brand products are good examples of custom colors which are required to meet exacting color standards in a highlight color or spot color printing application.

The various colors typically utilized for standard highlighting processes generally do not precisely match customer selectable colors. Moreover, customer selectable colors typically cannot be accurately generated via halftone process color methods because the production of solid image areas of a particular color using halftone image processing techniques typically yields nonuniformity of the color in the image area. Further, lines and text produced by halftone process color are very sensitive to misregistration of the multiple color images such that blurring, color variances, and other image quality defects may result.

As a result of the deficiencies noted above, customer selectable color production in electrostatographic printing systems is typically carried out by providing a singular premixed developing material composition made up of a mixture of multiple color toner particles blended in preselected concentrations for producing the desired customer selectable color output. This method of mixing multiple color toners to produce a particular color developing material is analogous to processes used to produce customer selectable color paints and inks. In offset printing, for example, a customer selectable color output image is produced by printing a solid image pattern with a premixed customer selectable color printing ink as opposed to printing a plurality of halftone image patterns with various primary colors or compliments thereof. This concept has generally been extended to electrostatographic printing technology, as disclosed, for example, in commonly assigned U.S. Pat. No. 5,557,393, wherein an electrostatic latent image is developed by a dry powder developing material comprising two or more compatible toner compositions to produce a customer selectable color output.

Customer selectable color printing materials including paints, printing inks and developing materials can be manufactured by determining precise amounts of constituent basic color components making up a given customer selectable color material, providing precisely measured amounts of each basic color component, and thoroughly mixing these color components. This process is commonly facilitated by reference to a color guide or swatch book containing hundreds or even thousands of swatches illustrating different colors, wherein each color swatch is associated with a specific formulation of colorants. Probably the most popular of these color guides is published by Pantone®, Inc. of Moonachie, N.J. The Pantone® Color Formula Guide expresses colors using a certified matching system and provides the precise formulation necessary to produce a specific customer selectable color by physically intermixing predetermined concentrations of up to four colors from a set of up to 16 principal or basic colors. There are many colors available using the Pantone® system or other color formula guides of this nature that cannot be produced via typical halftone process color methods or even by mixing selected amounts of cyan, magenta, yellow and/or black inks or developing materials.

In the typical operational environment, an electrostatographic printing system may be used to print various customer selectable color documents. To that end, replaceable containers of premixed customer selectable color developing materials corresponding to each customer selectable color are provided for each print job. Replacement of the premixed customer selectable color developing materials or substitution of another premixed color between different print jobs necessitates operator intervention which typically requires manual labor and machine downtime, among other undesirable requirements. In addition, since each customer selectable color is typically manufactured at an off-site location, supplies of each customer selectable color printing ink must be separately stored for each customer selectable color print job.

Previously referenced U.S. Pat. No. 5,557,393, hereby incorporated by reference into the present application, discloses that it may be desirable to provide an electrostatographic printing system with the capability of easily generating various customer selectable color output prints, in particular customer selectable color highlight color prints, wherein the developing material utilized to generate the customer selectable color output is formed of a mixture of at least two different basic color components provided in particular predetermined ratios. That patent also discloses that it is desirable to provide an electrostatographic imaging process wherein two or more color developing materials can be dispensed from separate dispensers so as to blended for developing a latent image. The developer material, therefore, is made up of a blend or mixture including of two or more color toner compositions. The present invention addresses the problem of replenishing various color developing material components making up a composite developing material mixture used to produce a custom color output image. That is, since the color components in the developing material mixture are depleted during the development process, the individual color components must be replenished. Moreover, since each developing material is made up of various developing materials which typically have different mobilities, the rate of depletion of each developing material component is differentially depleted the rate of replenishment of each of the developing material components must be managed and controlled in order to provide a steady-state condition with respect to the output color produced by the developing material mixture.

The purpose of the present invention may be more readily understood by comparison to a typical liquid developing material-based electrostatographic system, wherein a liquid developing material reservoir is continuously replenished by the addition of various components making up the liquid developing material: namely liquid carrier, charge director, and a concentrated dispersion of one particular type of pigmented marking or toner particles in the carrier liquid, as necessary. This replenishment must be constantly monitored and controlled to provide a predetermined ratio and concentration of toner particles, liquid carrier, and charge director in the liquid developing material reservoir. The present invention builds on that concept by providing a system in which the color of a developed customer selectable color image is monitored to control the rate of replenishment of various basic color components used to produce the customer selectable color developing material, thereby varying the concentration levels of each of the basic color components making up the customer selectable color developing material mixture in an operative developing material supply reservoir. Thus, the present invention contemplates a development system including a color mixing system, wherein the color value of the developing material in a supply reservoir can be maintained and the rate of replenishment of various color components added to the supply reservoir can be selectively varied and/or controlled. By adding and mixing precise amounts of specific developing materials from a set of basic color components, the actual color of the developing material in the reservoir is brought into agreement with a predetermined selected color. Moreover, by controlling the replenishment process accordingly, a wide range of customer selectable color developing materials can be produced and maintained over very long print runs.

The following disclosures may be relevant to some aspects of the present invention:

U.S. Pat. No. 5,557,393

Patentee: Goodman et al.

Issued: Sep. 17, 1996

U.S. Pat. No. 5,369,476

Patentee: Bowers et al.

Issued: Nov. 29, 1994

U.S. Pat. No. 5,240,806

Patentee: Tang et. al.

Issued: Aug. 31, 1993

Xerox Disclosure Journal, Vol. 21, No. 2, pp. 155–157

Author: Goodman

Published: March/April 1996

The relevant portions of the foregoing patents may be briefly summarized as follows:

U.S. Pat. No. 5,557,393 discloses an electrostatographic imaging process including the formation of an electrostatic latent image on an image forming device, developing the electrostatic latent image on the image forming device with at least one developer containing carrier particles and a blend of two of more compatible toner compositions, and transferring the toner image to a receiving substrate and fixing it thereto. Among the compatible toner compositions that may be selected are toner compositions having blend compatibility components coated on an external surface of the toner particles and particulate toner compositions containing therein blend compatibility components or passivated pigments. Electrostatographic imaging devices, including a tri-level imaging device and a hybrid scavengeless development imaging device, are also provided for carrying out the described process.

U.S. Pat. No. 5,369,476 discloses a toner control system and method for electrographic printing in which toner is delivered from a reservoir to a toner fountain for application to an electrostatically charged sheet to form an image. The visual quality of the image is monitored, and toner concentrate is added to the toner in response to the monitored quality to increase the amount of pigment particles in the toner and to thereby maintain a substantially constant image quality. In the disclosed embodiments, a test image is formed outside the main image on the sheet, and the brightness of one or more predetermined colors in the test image is monitored.

U.S. Pat. No. 5,240,806 discloses a liquid color toner composition for use in contact and gap electrostatic transfer processes, wherein the toner comprises a colored predispersion including: a non-polymeric resin material having certain insolubility (and non-swellability), melting point, and acid number characteristics; and alkoxylated alcohol having certain insolubility (and non-swellability) and melting point characteristics; and colorant material having certain particle size characteristics. The toner further comprises an aliphatic hydrocarbon liquid carrier having certain conductivity, dielectric constant, and flash point.

Xerox Disclosure Journal, Vol. 21, No. 2, pp. 155–157 discloses customer selectable color liquid ink development and a customer selectable color liquid ink development process wherein two or more liquid colored inks are applied simultaneously, in proper predetermined relative amounts, to provide custom or customer specified color images. The processes comprise, for example, providing a liquid development apparatus with at least one developer housing containing a liquid developer comprised of at least two different colored inks that are premixed at a desired concentration ratio, and developing a latent image with the premixed liquid developer to afford customer selectable colored developed images.

SUMMARY OF THE INVENTION

In accordance with one aspect of the present invention, there is provided a system for providing a color developing material for printing a customer selectable color image area on an output substrate in an electrostatographic printing machine, comprising: a plurality of developing material supply receptacles, each containing a differently colored developing material concentrate corresponding to basic color components of a color matching system; a developing material reservoir, having at least one of the plurality of developing material supply receptacles coupled thereto, for providing an operative supply of developing material including a mixture of selected basic color components; and a system for replenishing the developing material reservoir with selected differently colored developing material concentrates in a predetermined ratio.

In accordance with another aspect of the present invention, there is provided an apparatus for developing an electrostatic latent image with a developing material having a specified ratio of different color components to produce a customer selectable color image area on an output substrate, comprising: a plurality of developing material supply receptacles, each containing a differently colored developing material concentrate corresponding to the different color components; a developing material reservoir, having at least one of the plurality of developing material supply receptacles coupled thereto, for providing an operative supply of developing material including a mixture of selected color components; and a system for replenishing the developing material reservoir with selected differently colored developing material concentrates in a predetermined ratio.

In accordance with another aspect of the present invention, an electrostatographic printing apparatus is provided, including at least one development subsystem for developing at least a portion of an electrostatic latent image with a developing material having a specified ratio of different color components to produce a customer selectable color image area on an output substrate, comprising: a plurality of developing material supply receptacles, each containing a differently colored developing material concentrate corresponding to the different color components; a developing material reservoir, having at least one of the plurality of developing material supply receptacles coupled thereto, for providing an operative supply of developing material including a mixture of selected color components; and a system for replenishing the developing material reservoir with selected differently colored developing material concentrates in a predetermined ratio.

In accordance with yet another aspect of the present invention, an electrostatographic printing process is provided, wherein at least a portion of an electrostatic latent image is developed with a developing material having a specified ratio of different color components to produce a customer selectable color image area on an output substrate, comprising the steps of: providing a plurality of developing material supply receptacles, each containing a differently colored developing material concentrate corresponding to the different color components; selectively delivering at least one of the plurality of differently colored developing concentrate materials to a developing material reservoir for providing an operative supply of developing material including a mixture of selected color components; and systematically dispensing selected differently colored developing material concentrates in a predetermined ratio for replenishing the developing material reservoir.

Another significant aspect of the present invention is that the replenishment system may also be utilized to mix a customer selectable color in situ, whereby approximate amounts of primary color components are initially deposited and mixed in the developing material reservoir and the resultant operative developing material mixture is continually replenished with a predetermined ratio of color components until the developing material mixture reaches a steady state color.

BRIEF DESCRIPTION OF THE DRAWING

Other aspects of the present invention will become apparent as the following description proceeds and upon reference to FIG. 1, which provides a schematic, elevational view of an exemplary liquid developing material applicator and an exemplary liquid developing material development system incorporating a developing material color mixing system in accordance with the present invention. While the present invention will be described with respect to a liquid developing apparatus, it will be understood that the mixing and control system of the present invention is not limited to liquid developing materials and may be utilized in dry powder electrostatographic applications as well as liquid electrostatographic applications.

DETAILED DESCRIPTION OF THE INVENTION

Figure 1:
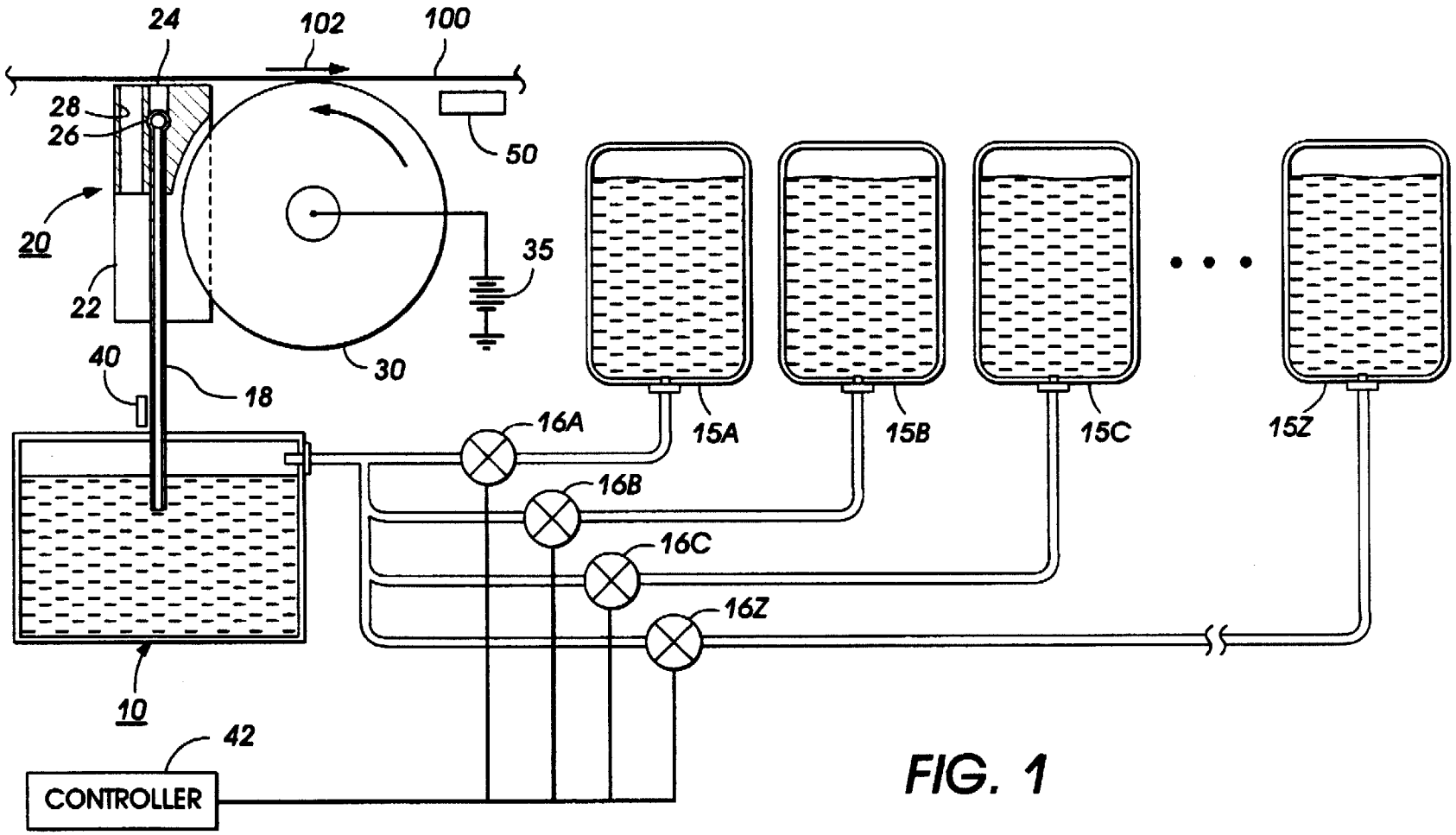

Since the art of electrostatographic printing is well known, it is noted that several concepts for electrostatographic highlight, spot and/or high fidelity color imaging systems which could make beneficial use of the color mixing and control system of the present invention have been disclosed in the relevant patent literature. One of the more elegant and practical of these concepts is directed toward single-pass highlight color tri-level imaging. In general, tri-level imaging involves the creation of two different electrostatic latent images at different voltage levels generated in a single imaging step, with a background or non-image area at yet another intermediate voltage level. Typically, one latent image is developed using charged-area development (CAD) techniques, while the other is developed via discharged-area development (DAD) techniques. This is accomplished by using positively charged toner for one color and negatively charged developing materials for the other, in separate housings. For example, by providing one developing material in black and the other in a selected color for highlighting, two different color images can be created on a single output document in a single processing cycle. This concept for tri-level xerography, is disclosed in U.S. Pat. No. 4,078,929, issued in the name of Gundlach, incorporated by reference herein. As disclosed therein, tri-level xerography involves the modification of known xerographic processes, such that the xerographic contrast on the charge retentive surface or photoreceptor is divided three ways, rather than two, as in the case in conventional xerography. Thus the photoreceptor is imagewise exposed such that one image, corresponding to charged image areas, is maintained at the full photoreceptor potential ($V_{ddp}$ or $V_{cad}$) while the other image, which corresponds to discharged image areas is exposed to discharge the photoreceptor to its residual potential, i.e. $V_c$ or $V_{dad}$. The background areas are formed by exposing areas of the photoreceptor at $V_{ddp}$ to reduce the photoreceptor potential to halfway between the $V_{cad}$ and $V_{dad}$ potentials, and is referred to as $V_w$ or $V_{white}$.

While the present invention may find particular application in tri-level highlight color imaging, it will become apparent from the following discussion that the color mixing and control system of the present invention may be equally well-suited for use in a wide variety of printing machines and is not necessarily limited in its application to the particular single-pass highlight tri-level electrostatographic process described by Gundlach. In fact, it is intended that the color mixing and control system of the present invention may be extended to any electrostatographic printing process intended to produce a customer selectable color image area including multi-color printing machines which may be provided with an ancillary customer selectable color development housing, as well as printing machines which carry out ionographic printing processes and the like. More generally, while the color mixing and control system of the present invention will hereinafter be described in connection with a preferred embodiment thereof, it will be understood that the description of the invention is not intended to limit the scope of the present invention to this preferred embodiment. On the contrary, the present invention is intended to cover all alternatives, modifications, and equivalents as may be included within the spirit and scope of the invention as defined by the appended claims.

Turning now to FIG. 1, an exemplary apparatus for developing an electrostatic latent image, wherein liquid developing materials are utilized is depicted in schematic form. Typically, a highlight color electrostatographic printing machine would include at least two developing apparatus operating with different color liquid developing materials for developing latent image areas into different colored visible images. By way of example, in a tri-level system of the type described hereinabove, a first developer apparatus might be utilized to develop the positively charged image area with black colored liquid developing material, while a second developer apparatus might be used to develop the negatively charged image area image with a customized color. In the case of liquid developing materials, each different color developing material comprises pigmented toner or marking particles, as well as charge control additives and charge directors, all disseminated through a liquid carrier, wherein the marking particles are charged to a polarity opposite in polarity to the charged latent image to be developed.

The developing apparatus of FIG. 1 operates primarily to transport liquid developer material into contact with a latent image on a photoreceptor surface, generally identified by reference numeral 100, wherein the marking particles are attracted, via electrophoresis, to the electrostatic latent image for creating a visible developed image thereof. With respect to the developing material transport and application process, the basic manner of operation of each developer apparatus is generally identical to one another and the developing apparatus shown in FIG. 1 represents only one of various known apparatus that can be utilized to apply liquid developing material to the photoconductive surface. It will be understood that the basic development system incorporating the mixing and control system of the present invention may be directed to either liquid or dry powder development and may take many forms, as for example, systems described in U.S. Pat. Nos. 3,357,402; 3,618,552; 4,733,273; 4,883,018; 5,270,782 and 5,355,201 among numerous others. Such development systems may be utilized in a multicolor electrophotographic printing machine, a highlight color machine, or in a monochromatic printing machine. In general, the only distinction between each developer unit is the color of the liquid developing material therein. It will be recognized, however, that only developer applicators which require the capability of generating customer selectable color outputs will be provided with the customer selectable color mixing system of the present invention.

Focusing on the development process before describing the color mixing system of the present invention, the exemplary developing apparatus of FIG. 1 shows a system for transporting a liquid developing material from a supply reservoir 10 to the latent image on the photoreceptor 100 via a liquid developing material applicator 20. Supply reservoir 10 acts as a holding receptacle for providing an operative solution of customized color liquid developing material comprised of liquid carrier, a charge director compound, and toner material, which, in the case of the customer selectable color application of the present invention, includes a blend of different colored marking particles. In accordance with the present invention, a plurality of replaceable supply dispensers 15A–15Z, each containing a concentrated supply of marking particles and carrier liquid corresponding to a basic color component in a color matching system, are provided in association with the operational supply reservoir 10 and coupled thereto for replenishing the liquid developing material therein, as will be described.

The exemplary developing material applicator 20 includes a housing 22, having an elongated aperture 24 extending along a longitudinal axis thereof so as to be oriented substantially transverse to the surface of photoreceptor 100, along the direction of travel thereof, as indicated by arrow 102. The aperture 24 is coupled to an inlet port 26 which is further coupled to reservoir 10 via transport conduit 18. Transport conduit 18 operates in conjunction with aperture 24 to provide a path of travel for developing material being transported from reservoir 10 and also defines a developing material application region in which the developing material can freely flow in order to contact the surface of the photoreceptor belt 100 for developing the latent image thereon. Thus, with reference to FIG. 1, liquid developing material is pumped or otherwise transported from the supply reservoir 10 to the applicator 20 through at least one inlet port 26, such that the liquid developing material flows out of the elongated aperture 24 and into contact with the surface of photoreceptor belt 100. An overflow drainage channel (not shown), partially surrounding the aperture 24, may also be provided for collecting excess developing material which may not be transferred over to the photoreceptor surface during development. Such an overflow channel would be connected to an outlet channel 28 for removal of excess or extraneous liquid developing material and, preferably, for directing this excess material back to reservoir 10 or to a waste sump whereat the liquid developing material can preferably be collected and the individual components thereof can be recycled for subsequent use.

Slightly downstream of and adjacent to the developing material applicator 20, in the direction of movement of the photoreceptor surface 100, is an electrically biased developer roller 30, the peripheral surface thereof being situated in close proximity to the surface of the photoreceptor 100. The developer roller 30 rotates in a direction opposite the movement of the photoconductor surface 100 so as to apply a substantial shear force to the thin layer of liquid developing material present in the area of the nip between the developer roller 30 and the photoreceptor 100, for minimizing the thickness of the liquid developing material on the surface thereof. This shear force removes a predetermined amount of excess liquid developing material from the surface of the photoreceptor and transports this excess developing material in the direction of the developing material applicator 20. The excess developing material eventually falls away from the rotating metering roll for collection in the reservoir 10 or a waste sump (not shown). A DC power supply 35 is also provided for maintaining an electrical bias on the metering roll 30 at a selected polarity and magnitude such that image areas of the electrostatic latent image on the photoconductive surface will attract marking particles from the developing material for developing the electrostatic latent image. This electrophoretic development process minimizes the existence of marking particles in background regions and maximizes the deposit of marking particles in image areas on the photoreceptor.

In operation, liquid developing material is transported in the direction of the photoreceptor 100, filling the gap between the surface of the photoreceptor and the liquid developing material applicator 20. As the belt 100 moves in the direction of arrow 102, a portion of the liquid developing material in contact with the photoreceptor moves therewith toward the developing roll 30 where marking particles in the liquid developer material are attracted to the electrostatic latent image areas on the photoreceptor. The developing roller 30 also meters a predetermined amount of liquid developing material adhering to the photoconductive surface of belt 100 and acts as a seal for preventing extraneous liquid developing material from being carried away on the photoreceptor.

As previously indicated, liquid developing materials of the type suitable for electrostatographic printing applications generally comprise marking particles and charge directors dispersed in a liquid carrier medium, with an operative solution of the developing material being stored in reservoir 10. Generally, the liquid carrier medium is present in a large amount in the liquid developing material composition, and constitutes that percentage by weight of the developer not accounted for by the other components. The liquid medium is usually present in an amount of from about 80 to about 99.5 percent by weight, although this amount may vary from this range provided that the objectives of the present invention can be achieved. By way of example, the liquid carrier medium may be selected from a wide variety of materials, including, but not limited to, any of several hydrocarbon liquids conventionally employed for liquid development processes, including hydrocarbons, such as high purity alkanes having from about 6 to about 14 carbon atoms, such as Norpar® 12, Norpar® 13, and Norpar® 15, and including isoparaffinic hydrocarbons such as Isopar® G, H, L, and M, available from Exxon Corporation. Other examples of materials suitable for use as a liquid carrier include Amsco® 460 Solvent, Amsco® OMS, available from American Mineral Spirits Company, Soltrol®, available from Phillips Petroleum Company, Pagasol®, available from Mobil Oil Corporation, Shellsol®, available from Shell Oil Company, and the like. Isoparaffinic hydrocarbons provide a preferred liquid media, since they are colorless, and environmentally safe.

The marking or so-called toner particles of the liquid developing material can comprise any particle material compatible with the liquid carrier medium, such as those contained in the developers disclosed in, for example, U.S. Pat. Nos. 3,729,419; 3,841,893; 3,968,044; 4,476,210; 4,707,429; 4,762,764; 4,794,651; and 5,451,483, among others, the disclosures of each of which are totally incorporated herein by reference. Preferably, the toner particles should have an average particle diameter ranging from about 0.2 to about 10 microns, and most preferably between about 0.5 and about 2 microns. The toner particles may be present in the operative liquid developing material in amounts of from about 0.5 to about 20 percent by weight, and preferably from about 1 to about 4 percent by weight of the developer composition. The toner particles can consist solely of pigment particles, or may comprise a resin and a pigment; a resin and a dye; or a resin, a pigment, and a dye or resin alone. Other compounds including charge control additives may be optionally included.

Examples of thermoplastic resins include ethylene vinyl acetate (EVA) copolymers, (ELVAX® resins, E.I. DuPont de Nemours and Company, Wilmington, Del.); copolymers of ethylene and an a-b-ethylenically unsaturated acid selected from the group consisting of acrylic acid and methacrylic acid; copolymers of ethylene (80 to 99.9 percent), acrylic or methacrylic acid (20 to 0.1 percent)/alkyl (C1 to C5) ester of methacrylic or acrylic acid (0.1 to 20 percent); polyethylene; polystyrene; isotactic polypropylene (crystalline); ethylene ethyl acrylate series available under the trademark BAKELITE® DPD 6169, DPDA 6182 NATURAL® (Union Carbide Corporation, Stamford, Conn.); ethylene vinyl acetate resins like DQDA 6832 Natural 7 (Union Carbide Corporation); SURLYN® ionomer resin (E.I. DuPont de Nemours and Company); or blends thereof; polyesters; polyvinyl toluene; polyamides; styrene/butadiene copolymers; epoxy resins; acrylic resins, such as a copolymer of acrylic or methacrylic acid, and at least one alkyl ester of acrylic or methacrylic acid wherein alkyl is 1 to 20 carbon atoms, such as methyl methacrylate (50 to 90 percent)/methacrylic acid (0 to 20 percent)/ethylhexyl acrylate (10 to 50 percent); and other acrylic resins including ELVACITE® acrylic resins (E.I. DuPont de Nemours and Company); or blends thereof. Preferred copolymers selected in embodiments are comprised of the copolymer of ethylene and an a-b-ethylenically unsaturated acid of either acrylic acid or methacrylic acid. In a preferred embodiment, NUCREL® resins available from E.I. DuPont de Nemours and Company like NUCREL 599®, NUCREL 699®, or NUCREL 960® are selected as the thermoplastic resin.

In embodiments, the marking particles are comprised of thermoplastic resin, a charge adjuvant, and the pigment, dye or other colorant. Therefore, it is important that the thermoplastic resin and the charge adjuvant be sufficiently compatible that they do not form separate particles, and that the charge adjuvant be insoluble in the hydrocarbon liquid carrier to the extent that no more than 0.1 weight percent be soluble therein. Any suitable charge director, such as, for example, a mixture of phosphate ester and aluminum complex can be selected for the liquid developers in various effective amounts, such as, for example, in embodiments from about 1 to 1,000 milligrams of charge director per gram of toner solids and preferably 10 to 100 milligrams/gram. Developer solids include toner resin, pigment, and optional charge adjuvant.

Liquid developing materials preferably contain a colorant dispersed in the resin particles. Colorants, such as pigments or dyes like black, white, cyan, magenta, yellow, red, blue, green, brown, and mixtures wherein any one colorant may comprise from 0.1 to 99.9 weight percent of the colorant mixture with a second colorant comprising the remaining percentage thereof are preferably present to render the latent image visible. The colorant may be present in the resin particles in an effective amount of, for example, from about 0.1 to about 60 percent, and preferably from about 10 to about 30 percent by weight based on the total weight of solids contained in the developer. The amount of colorant selected may vary depending on the use of the developer; for instance, if the toned image is to be used to form a chemical resist image no pigment is necessary. Clear, unpigmented developing materials may also be used to lighten the printed images. Examples of colorants such as pigments which may be selected include carbon blacks available from, for example, Cabot Corporation (Boston, Mass.), such as MONARCH 1300®, REGAL 330® and BLACK PEARLS® and color pigments like FANAL PINK®, PV FAST BLUE®, Titanium Dioxide (white) and Paliotol Yellow D1155; as well as the numerous pigments listed and illustrated in U.S. Pat. Nos. 5,223,368; 5,484,670, the disclosures of which are totally incorporated herein by reference.

As previously discussed, in addition to the liquid carrier vehicle and toner particles which typically make up the liquid developer materials, a charge director compound (sometimes referred to as a charge control additive) is also provided for facilitating and maintaining a uniform charge on the marking particles in the operative solution of the liquid developing material by imparting an electrical charge of selected polarity (positive or negative) to the marking particles.

Examples of suitable charge director compounds and charge control additives include lecithin, available from Fisher Inc.; OLOA 1200, a polyisobutylene succinimide, available from Chevron Chemical Company; basic barium petronate, available from Witco Inc.; zirconium octoate, available from Nuodex; as well as various forms of aluminum stearate; salts of calcium, manganese, magnesium and zinc; heptanoic acid; salts of barium, aluminum, cobalt, manganese, zinc, cerium, and zirconium octoates and the like. The use of quaternary charge directors as disclosed in the patent literature may also be desirable. The charge control additive may be present in an amount of from about 0.01 to about 3 percent by weight, and preferably from about 0.02 to about 0.20 percent solids by weight of the developer composition.

The application of developing material to the photoconductive surface clearly depletes the overall amount of the operative solution of developing material in supply reservoir 10. In the case of the liquid developing materials, marking particles are depleted in the image areas; carrier liquid is depleted in the image areas (trapped by marking particles) and in background areas, and may also be depleted by evaporation; and charge director is depleted in the image areas (trapped in the carrier liquid), in the image areas adsorbed onto marking particles, and in the background areas. In general practice, therefore, reservoir 10 is continuously replenished, as necessary, by the addition of developing material or selective components thereof, for example in the case of liquid developing materials, by the addition of liquid carrier, marking particles, and/or charge director into the supply reservoir 10. Since the total amount of any one component making up the developing material utilized to develop the image may vary as a function of the area of the developed image areas and the background portions of the latent image on the photoconductive surface, the specific amount of each component of the liquid developing material which must be added to the supply reservoir 10 varies with each development cycle. For example, a developed image having a large proportion of printed image area will cause a greater depletion of marking particles and/or charge director from a developing material reservoir as compared to a developed image with a small amount of printed image area.

Thus, it is known in the art that, while the rate of the replenishment of the liquid carrier component of the liquid developing material may be controlled by simply monitoring the level of liquid developer in the supply reservoir 10, the rate of replenishment of the marking particles, and/or the charge director components of the liquid developing material in reservoir 10 must be controlled in a more sophisticated manner to maintain the correct predetermined concentration for proper functionality of the marking particles and the charge director in the operative solution stored in the supply reservoir 10 (although the concentration may vary with time due to changes in operational parameters). Systems have been disclosed in the patent literature and otherwise for systematically replenishing individual components making up the liquid developing material (liquid carrier, marking particles and/or charge director) as they are depleted from the reservoir 10 during the development process. See, for example, commonly assigned U.S. patent application Ser. No. 08/551,381 and the references cited therein.

The present invention, however, contemplates a developing material replenishing system capable of systematically replenishing individual color components making up a customer selectable color developing material composition in proportions corresponding to a customer selected color. As such, the replenishment system of the present invention may include a plurality of differently colored concentrate supply dispensers 15A, 15B, 15C, . . . 15Z, each coupled to the operative supply reservoir 10 via an associated valve member 16A, 16B, 16C, . . . 16Z, or other appropriate supply or flow control device. It will be understood that these valves may be replaced by pump devices or any other suitable flow control mechanisms as known in the art, so as to be substituted thereby. Preferably, each supply dispenser contains a developing material concentrate of a known basic or primary color component used in a given color matching system. It will be understood that each of the plurality of supply dispensers 15A–15Z may be coupled to the reservoir 10, or only selected supply dispensers may be coupled to the reservoir 10. For example, under certain circumstances, such as space constraints or cost restraints, it may be desirable to use only a specific set of color components, for example, the developing materials in dispensers 15A, 15B and 15C, making up a simplified color matching system or the basic color components necessary to provide a specific customer selectable color. Indeed, as few as one supply dispenser can be utilized in the case where the developing material is provided as a premixture of color components in proportions to be printed corresponding to the customer selectable color.

In one specific embodiment, the replenishment system includes sixteen supply dispensers, wherein each supply dispenser provides a different basic color developing material corresponding to the sixteen basic or constituent colors of the Pantone® Color Matching System such that color formulations conveniently provided thereby can be utilized to produce over a thousand desirable colors and shades in a customer selectable color printing environment. Using this system, as few as two different color developing materials, for example, from supply containers 15A and 15B, are combined in reservoir 10 to expand the color gamut of customer selectable colors far beyond the colors available via halftone imaging techniques or even the colors available from mixing just Yellow, Magenta, Cyan and Black colored developing materials.

It will be recognized that, since there are different developing materials in the supply of operative developing material in reservoir 10, the resulting mobility of each color component is likely to be different, resulting in different rates of development or depletion of each component from reservoir 10. Differential development of each component will cause the color of the operative supply of developing material to drift over time, resulting in unacceptable color errors in the color output image. During long print runs, differential development of developing material components can change the proportions of developing material components in the developing material reservoir 10.

One solution to the problem of differential development of color components is to provide a system for sensing changes in the color of the operative developing material supply reservoir caused by differential development in order to facilitate the controlled addition of individual basic color components in compensating proportions. In this way, the component proportions, and thus the color of the supply of operative developing material can be maintained substantially constant during long print runs. Similarly, methods of sensing the printed image on paper or at earlier stages (on the photoreceptor or an intermediate belt) might be used to correct the target proportions of developing material color components to compensate for color shift in the supply of operative developing material. Such systems can maintain the developing material supply component concentrations constant, wherein developing material supply component concentrations are sensed and individual components are added in such a way to keep component concentrations constant. In such sensing control systems, the color is maintained stable, but the color will not converge to the customer-selected target value. By contrast, the process of the present invention functions to maintain the color output regardless of whether the initial DMA ratio of the color components is above or below the ratio at which the color components are replenished.

The present invention provides a relatively simple solution to the problem of differential development of basic color components in a developing material mixture comprising more than two developing materials. As such, the developing material color replenishment system of the present invention is provided with a mixing control system including a color mixing controller 42 coupled to control valves 16A–16Z for selective actuation thereof to control the flow of developing material from each supply container 15A–15Z. Controller 42 may take the form of any known microprocessor based memory and processing device as are well known in the art. More specifically, the replenishment system is generally adapted to replenish the developing material reservoir 10 with selected differently colored developing material concentrates in a predetermined ratio. The controller 42 regulates the amounts of each color developing material in supply containers 15A, 15B . . . or 15Z to be added to supply reservoir 10 such that the replenishment system is generally adapted to replenish the developing material reservoir 10 with selected differently colored developing material concentrates in a predetermined ratio in accordance with a specific procedure to be described.

In accordance with the present invention, controller 42 operates to regulate the input of each basic color component developing material into reservoir 10 so as to be proportionally identical to the known color component proportions present in the customer selectable color output. This process is facilitated by providing controller 42 with information corresponding to the precise component proportions making up a given customer selectable color. For example, using the Pantone® Color Matching System over a thousand different formulations of customer selectable color are stored in the memory of controller 42. Thus, specific supplied ratios of color components can be provided as a predetermined value for each customer selectable color.

The supplied ratio defines the precise proportions of each basic color component necessary to produce the customer selected color, and is preferably provided via a look up table provided in a memory device of controller 42. This look up table is accessed for any given customer selected color to control the actuation of valves 16A–16Z so as to replenish the developing material reservoir with selected differently colored developing material concentrates in accordance with the supplied ratio. Thus, the respective color components of the given selected color are dispensed in accordance with a predetermined ratio as provided by the look up table.

The method of the present invention consists of at least two steps. In the first step, target developing material proportions are determined which match the target color. In the second step, the developing material supply is replenished in the proportions determined in the first step.

Focusing initially on the first step of determining the ratio of the developing material color components required to print a customer-selected color, this ratio can be a predetermined ratio which may be supplied in rough approximation by the color matching system or derived in rough approximation from the formulations provided thereby. Alternatively, the relative proportions can be determined as target weight fractions for each color component to be printed in order to get a proper color match, based the printed mass per unit area (PMA) for each component. The target weight fractions can be determined by non-electrophotographic methods, such as drawdowns or filtrations. These methods for determining target weight fractions may be preferred since they are not subject to variations due to developing material mobility changes with time.

A specific example will now be provided, showing the use of filtration to find the proportions of Yellow and Warm Red developing materials necessary to match Pantone® 151 (an orange). In this example Yellow and Warm Red developing materials were each diluted to 0.00192 wt % developing material solids in order to provide uniform filtration. The target total developed mass per unit area (DMA) was 0.1 mg/cm$^2$, on a filtration area of 10 cm$^2$. 50 gram samples were prepared by mixing two developing materials in proportions shown below and deposited on paper by filtration. After filtration, each sample was fused in an oven for about 30 minutes. After cooling, the color of each sample was measured and defined as shown in the following table, wherein colors are expressed in the well recognized standardized color notation system for defining uniform color spaces developed by the Commission Internationale de l'Eclairage (CIE). Comparison to the target color led to selection of 70% Yellow, 30% Warm Red as an optimum match to Pantone 151.

| % Yellow (mass) | % WarmRed (grams) | L* | a* | b* |
|---|---|---|---|---|
| 80% (40.020 g) | 20% (9.992 g) | 75.50 | 33.20 | 75.60 |
| 75% (37.508 g) | 25% (12.512 g) | 73.52 | 37.62 | 71.48 |
| 70% (34.967 g) | 30% (14.993 g) | 69.95 | 45.99 | 71.86 |
| Target color: Pantone 151 | | 64.34 | 50.01 | 80.88 |

Continuing with the process of the present invention, color prints are produced, wherein a mix of color components in the developing material utilized to produce the prints is replenished in accordance with the proportions determined in the filtration step described above. As previously discussed, even if the developabilities of each color component are not equal, the component ratio being removed by development at steady state are exactly equal to the ratio being added by replenishment.

The simplicity of the concept of the present invention conceals its power. That is, conventional thinking would lead one to provide a sophisticated control system, likely to include costly sensing and monitoring devices in order to provide proper color control in customer selectable color applications. However, the process of the present invention allows for a simple control and maintenance of an output color by simply inputting into the operative developing material supply exactly what is taken out of the supply.

As an illustrative example, continuing with the example above, it will be assumed that the target printed mass per unit area ratio for a given developing material having two basic color components is 2.333. Accordingly, the operative developing material supply is made up of the two basic color developing material components, initially having a 70/30 ratio. However, due to differential developability of each component, the initial developed mass per unit area (DMA) ratio is closer to 2.57 such that the relative color components are actually being developed out at a ratio of approximately 72/28. Without replenishment, any difference in developability causes a continuous drift in component ratios. The method of the other invention, on the other hand, insures that the actual DMA ratio will become 70/30 over time because the components are replenished in a 7/3 ratio.

In the foregoing example, the difference in color between the first print and the steady state prints is approximately 3.0 (where the color difference is defined as a Euclidean distance in the CIE standardized color notation system). The number of prints required to reach steady state is a function of supply volume, DMA, and average area coverage in each print. While this number can be reduced by reducing the volume of the developing material supply reservoir, the important feature to be noted is that the color is self-correcting.

It will be recognized that a significant color shift may occur between an initial print generated by an operative developing material having inappropriate proportions of each color component and the time that steady state color conditions are reached. To minimize the color shift from first print to steady state prints, and to minimize the time required to reach the steady state, the initial DMA ratios for each color component should be close to the target ratio. If component developabilities are known to be different on average, then the initial developing material supply can be made up in compensating proportions. All that is needed for practical use is that the initial color be close enough to the final color to satisfy customer expectations. The color differences between adjacent colors in the Pantone® Color Matching System are 10–15. Even for demanding applications, like matching one of the 1024 Pantone colors, the color difference between first print and steady state can probably approach 5–10. Indeed, there may be less demanding spot color applications where this color differences can be much larger.

Of course, for customers requiring exact color matches, such as in custom color applications,(e.g., Kodak® yellow or Hershey® brown), replenishment could be from a premixed concentrate with target proportions of the components. Similarly, the initial developing material supply could be made up automatically from individual components, or could be furnished as a premix. In addition, for demanding applications, it is possible to add additional color controls and adjustments to guarantee the correct color on the customer's first print. In one example, it would be possible to guarantee the correct color on the first print by printing a high area of coverage onto the photoreceptor, cleaning it off, and discarding that developing material, until all the developing material in the reservoir has been used and replenished a few times. Modeling shows two reservoir turnovers will yield a steady state color output. Of course, the time required to reach equilibrium can be reduced by reducing the size of the reservoir.

Alternatively, a color sensor can be provided to facilitate initial color adjustment. For example, the developing material supply can be filled half full with components in approximately the correct ratios and concentrations. Developing material is developed onto the photoreceptor and is color sensed, for example via sensor 50. That developing material can be cleaned off of the photoreceptor without transfer to paper. Sensor 50 is coupled to controller 42, whereby the component concentrations can be adjusted to move the color sensed on the photoreceptor closer to the target color. And this process can be iterated at the initiation of a particular custom color print job in order to provide correct color on the first print. It will be recognized that sensor 50 can also be situated to measure color at other locations in the printing process, for example in the developing material reservoir. Whichever method is used to get the color right on the first print, the replenishment method of this invention can be used to insure that color does not drift away from target during printing.

It will be understood that the foregoing methods represent only a few of the numerous and various processes that could be implemented for controlling the mixture of color components in order to provide a specified color output in accordance with the present invention. Most importantly, by using the system and method of the presently described replenishment system, the printed color will converge to the target color instead of drifting arbitrarily far from the target color, and the printed color is maintained constant by replenishing with a concentrate composition which may be different from the operative developing material supply composition. This replenishment system guarantees that the printed color will not drift arbitrarily far from the target color, but rather, the printed color always converges to the target color.

In summary, the components of a customer selectable color mixed developing material are replenished in the proportions which provide the desired printed color, even if the relative component concentrations in the developing material reservoir are different from the desired proportions. At steady state, the colors printed onto paper will be in the same proportions as those added by replenishment. A unique attribute of this replenishment method is that it maintains constant printed color output by replenishing the operative supply of developing material in reservoir 10 with a blend of developing material concentrates of different color components in a substantially fixed proportion which is different from the proportion of color components in the operative supply of developing material.

In review, the present invention provides a system and method for color mixing management in an electrostatographic printing system, wherein a developing material reservoir containing an operative solution of colored developing material made up of a mixture of selected color components is continuously replenished with selected differently colored developing material concentrates provided in a predetermined ratio so as to be capable of producing a customer selectable color image area on an output substrate. The present invention can be used to control and maintain the color of the developing material in the reservoir through continuous replenishment at the predetermined ratio in order to maintain a particular ratio or desired proportions of color components in the reservoir over extended periods associated with very long print runs. In another aspect of the invention, the initial proportions of the components in the reservoir are intentionally different from the proportions necessary to produce the customer selectable color print output. The user can purchase a premixed of the desired color. The controller can be used to mix the supply in proportions which compensate for developability differences, or the present invention may also be utilized to mix a customer selectable color in situ, whereby approximate amounts of primary color components are initially deposited and mixed in the developing material reservoir and the resultant operative developing material mixture is continually replenished with a predetermined ratio of color components until the developing material mixture reaches a steady state color.

It is, therefore, evident that there has been provided, in accordance with the present invention a color mixing replenishment system that fully satisfies the aspects of the invention hereinbefore set forth. While this invention has been described in conjunction with a particular embodiment thereof, it shall be evident that many alternatives, modifications and variations will be apparent to those skilled in the art. Accordingly, the present invention is intended to embrace all such alternatives, modifications and variations as fall within the spirit and broad scope of the appended claims.

We claim:

1. A system for providing a color developing material for printing a customer selectable color image area on an output, comprising:

a plurality of developing material supply receptacles, each containing a differently colored developing material concentrate corresponding to basic color components of a color matching system;

a developing material reservoir, having at least one of said plurality of developing material supply receptacles coupled thereto, for providing an operative supply of developing material including a mixture of selected basic color components; and a system for replenishing said developing material reservoir with selected differently colored developing material concentrates in a predetermined ratio, wherein said predetermined ratio of selected differently colored developing material concentrates is different than a ratio of selected differently colored developing material concentrates in said operative supply of developing material.

2. The system of claim 1, wherein said predetermined ratio corresponds to a supplied ratio associated with the customer selectable color.

3. The system of claim 2, wherein said supplied ratio is provided by the color matching system.

4. The system of claim 3, wherein the color matching system includes a Pantone® color matching system.

5. The system of claim 2, including means for determining said supplied ratio in response to printed mass per unit area for each basic color component making up a selected customer selectable color image.

6. The system of claim 1, further comprising:

a plurality of flow control devices, each associated with a respective one of said plurality of developing material supply receptacles; and a control system adapted to selectively actuate selected flow control devices associated with selected basic color components to provide the predetermined ratio of selected differently colored developing material concentrates.

7. The system of claim 6, wherein:

said control system includes a memory device for storing a list of supplied ratios corresponding to a plurality of different customer selectable colors selected from a color guide adapted provide a rendering of a customer selectable color output, and further wherein said control system is adapted to automatically selectively actuate selected flow control devices associated with selected basic color components to provide said supplied ratio so as to provide an output color substantially equivalent to a customer selectable color selected from the color guide.

8. The system of claim 1, wherein an initial ratio is different from the predetermined ratio so as to compensate for differential development of color components.

9. The system of claim 8, wherein the initial ratio corresponds to a ratio provided by a premixed mixture of color components.

10. The system of claim 8, further including a memory device, wherein the initial ratio corresponds to a ratio provided by a look up table in the memory device.

11. The system of claim 8, further including a color sensor, wherein the initial ratio corresponds to approximate proportions of color components derived from the color matching system.

12. The system of claim 8, wherein the initial ratio is equivalent to a ratio required to print the customer selectable color.

13. The system of claim 1, wherein said replenishing system is adapted to maintain a substantially constant customer selectable color output.

14. An apparatus for developing a latent image with a developing material having a specified ratio of different color components to produce a customer selectable color image area on an output substrate, comprising:

a plurality of developing material supply receptacles, each containing a differently colored developing material concentrate corresponding to the different color components;

a developing material reservoir, having at least one of said plurality of developing material supply receptacles coupled thereto, for providing an operative supply of developing material including a mixture of selected color components; and a system for replenishing said developing material reservoir with selected differently colored developing material concentrates in a predetermined ratio, wherein said predetermined ratio of selected differently colored developing material concentrates is different than a ratio of selected differently colored developing material concentrates in said operative supply of developing material.

15. The apparatus of claim 14, wherein said predetermined ratio of selected differently colored developing material concentrates corresponds to a supplied ratio of differently colored developing material concentrates associated with the customer selectable color.

16. The apparatus of claim 14, wherein an initial ratio is different from the predetermined ratio so as to compensate for differential development of color components.

17. The apparatus of claim 16, wherein the initial ratio corresponds to a ratio provided by a premixed mixture of color components.

18. The apparatus of claim 16, further including a memory device, wherein the initial ratio corresponds to a ratio provided by a look up table in the memory device.

19. The apparatus of claim 16, further including a color sensor, wherein the initial ratio corresponds to approximate proportions of color components derived from the color matching system.

20. The apparatus of claim 16, wherein an initial ratio is equivalent to a ratio required to print the customer selectable color.

21. The apparatus of claim 14, wherein said replenishing system is adapted to maintain a substantially constant customer selectable color output.

22. The apparatus of claim 15, including means for determining said supplied ratio in response to printed mass per unit area for each different color component making up a selected customer selectable color image.

23. The apparatus of claim 14, further comprising:

a plurality of flow control devices, each associated with a respective one of said plurality of developing material supply receptacles; and a control system adapted to selectively actuate selected flow control devices associated with selected different color components to provide the predetermined ratio of selected differently colored developing material concentrates.

24. The apparatus of claim 23, wherein:

said control system includes a memory device for storing a list of supplied ratios corresponding to a plurality of different customer selectable selected from a color guide adapted provide a rendering of a customer selectable color output, and further wherein said control system is adapted to automatically selectively actuate selected flow control devices associated with selected basic color components to provide said supplied ratio so as to provide an output color substantially equivalent to a customer selectable color selected from the color guide.

25. The apparatus of claim 14, wherein said different color components correspond to basic color components defined by a color matching system.

26. The apparatus of claim 25, wherein the color matching system includes a Pantone® color matching system.

27. The apparatus of claim 15, wherein said supplied ratio is provided by the color matching system.

28. The apparatus of claim 14, further including a developing material applicator coupled to said developing material supply reservoir, adapted for transporting developing material into contact with the electrostatic latent image.

29. The apparatus of claim 28, further including an electrically biased metering roll situated adjacent to, and downstream from said developing material applicator.

30. An electrostatographic printing apparatus including at least one development subsystem for developing at least a portion of an electrostatic latent image with a developing material having a specified ratio of different color components to produce a customer selectable color image area on an output substrate, comprising:

a plurality of developing material supply receptacles, each containing a differently colored developing material concentrate corresponding to the different color components;

a developing material reservoir, having at least one of said plurality of developing material supply receptacles coupled thereto, for providing an operative supply of developing material including a mixture of selected color components; and a system for replenishing said developing material reservoir with selected differently colored developing material concentrates in a predetermined ratio, wherein said predetermined ratio of selected differently colored developing material concentrates is different than a ratio of selected differently colored developing material concentrates in said operative supply of developing material.

31. The electrostatographic printing apparatus of claim 30, wherein said predetermined ratio of selected differently colored developing material concentrates corresponds to a supplied ratio of differently colored developing material concentrates associated with the customer selectable color.

32. The electrostatographic printing apparatus of claim 30, wherein an initial ratio is different from the predetermined ratio so as to compensate for differential development of color components.

33. The electrostatographic printing apparatus of claim 32, wherein the initial ratio corresponds to a ratio provided by a premixed mixture of color components.

34. The electrostatographic printing apparatus of claim 32, further including a memory device, wherein the initial ratio corresponds to a ratio provided by a look up table in the memory device.

35. The electrostatographic printing apparatus of claim 32, further including a color sensor, wherein the initial ratio corresponds to approximate proportions of color components derived from the color matching system.

36. The electrostatographic printing apparatus of claim 32, wherein said initial ratio is equivalent to a ratio required to print the customer selectable color.

37. The electrostatographic printing apparatus of claim 30, wherein said replenishing system is adapted to maintain a substantially constant customer selectable color output.

38. The electrostatographic printing apparatus of claim 31, including means for determining said supplied ratio in response to printed mass per unit area for each different color component making up a selected customer selectable color image.

39. The electrostatographic printing apparatus of claim 30, further comprising:

a plurality of flow control devices, each associated with a respective one of said plurality of developing material supply receptacles; and a control system adapted to selectively actuate selected flow control devices associated with selected different color components to provide the predetermined ratio of selected differently colored developing material concentrates.

40. The electrostatographic printing apparatus of claim 39, wherein:

said control system includes a memory device for storing a list of supplied ratios corresponding to a plurality of different customer selectable selected from a color guide adapted provide a rendering of a customer selectable color output, and further wherein said control system is adapted to automatically selectively actuate selected flow control devices associated with selected basic color components to provide said supplied ratio so as to provide an output color substantially equivalent to a customer selectable color selected from the color guide.

41. The electrostatographic printing apparatus of claim 30, wherein said different color components correspond to basic color components defined by a color matching system.

42. The electrostatographic printing apparatus of claim 41, wherein the color matching system includes a Pantone® color matching system.

43. The electrostatographic printing apparatus of claim 31, wherein said supplied ratio is provided by a color matching system.

44. The electrostatographic, printing apparatus of claim 30, further including a developing material applicator coupled to said developing material reservoir, adapted for transporting developing material into contact with the electrostatic latent image.

45. The electrostatographic printing apparatus of claim 44, further including an electrically biased metering roll situated adjacent to, and downstream from said developing material applicator.

46. An electrostatographic printing process, wherein at least a portion of an electrostatic latent image is developed with a developing material having a specified ratio of different color components to produce a customer selectable color image area on an output substrate, comprising the steps of:

providing a plurality of developing material supply receptacles, each containing a differently colored developing material concentrate corresponding to the different color components;

selectively delivering at least one of said plurality of differently colored developing concentrate materials to a developing material reservoir for providing an operative supply of developing material including a mixture of selected color components; and systematically dispensing selected differently colored developing material concentrates in a predetermined ratio for replenishing said developing material reservoir, wherein said predetermined ratio of selected differently colored developing material concentrates is different than a ratio of selected differently colored developing material concentrates in said operative supply of developing material.

47. The electrostatographic printing process of claim 46, wherein said predetermined ratio of selected differently colored developing material concentrates corresponds to a supplied ratio of differently colored developing material concentrates associated with the customer selectable color.

48. The electrostatographic printing process of claim 46, wherein said replenishing system is adapted to maintain a substantially constant customer selectable color output.

49. The electrostatographic printing process of claim 47, including means for determining said supplied ratio in response to printed mass per unit area for each different color component making up a selected customer selectable color image.

* * * * *